US006029840A

United States Patent [19]

Brauner

[11] Patent Number: 6,029,840

[45] Date of Patent: Feb. 29, 2000

[54] COLLAPSIBLE CONTAINER

[75] Inventor: Manfred Brauner, Vienna, Austria

[73] Assignee: Perstorp AB, Perstorp, Sweden

[21] Appl. No.: 09/171,608

[22] PCT Filed: Apr. 10, 1997

[86] PCT No.: PCT/SE97/00604

§ 371 Date: Dec. 23, 1998

§ 102(e) Date: Dec. 23, 1998

[87] PCT Pub. No.: WO97/39954

PCT Pub. Date: Oct. 30, 1997

[30] Foreign Application Priority Data

Apr. 22, 1996 [SE] Sweden ..... 9601513

[51] Int. Cl.[7] ..... B65D 7/24

[52] U.S. Cl. ..... 220/6; 220/659; 220/669; 220/675

[58] Field of Search ..... 220/6, 7, 4.28, 220/656, 659, 657, 658, 669, 675

[56] References Cited

U.S. PATENT DOCUMENTS

| | | | |
|---|---|---|---|
| 3,658,035 | 4/1972 | Harris | 220/6 |
| 4,674,647 | 6/1987 | Gyenge et al. | 220/6 |
| 4,775,068 | 10/1988 | Reiland et al. | 220/6 |
| 4,917,255 | 4/1990 | Foy et al. . | |
| 5,515,987 | 5/1996 | Jacques et al. | 220/6 |
| 5,746,341 | 5/1998 | Olson | 220/6 |

FOREIGN PATENT DOCUMENTS

| | | |
|---|---|---|
| 0067323 | 12/1982 | European Pat. Off. . |
| 0091718 | 10/1983 | European Pat. Off. . |

*Primary Examiner*—Joseph M. Moy
*Attorney, Agent, or Firm*—Stevens, Davis, Miller & Mosher, L.L.P.

[57] ABSTRACT

Collapsible container for transport and storage, comprising a bottom part (2) and side walls (1) movably connected to the bottom part (2) via hinges (3) which are formed by lower hinge-parts (3') and upper hinge-parts (3"). The hinge-parts (3', 3") are integrated with their respective part (1, 2). Two side walls (1), placed on opposite sides are provided with an inwards angled edge (4') at each of their two ends. The edges (4') connect, when in upright position, with the adjoining side walls (1). The inwards angled edges (4') are provided with a number of coupling devices (5) which are intended to interact with corresponding couplings (6) placed at the ends (4") of the adjoining side walls (1). The side walls (1) can hereby be locked together in an upright position. At least two opposite side walls (1), preferably all four, are provided with hollow channel-like reinforcing profiles (7) stretching along three sides of each of the side walls (1), wherein one of the sides is always an upper side (8).

16 Claims, 3 Drawing Sheets

COLLAPSIBLE CONTAINER

The present invention relates to a collapsible container for transport and storage.

Containers made from different materials such as wood, metal, plastic etc. are frequently used. One problem with such containers are that they often demand the same transport volume when returned to the source as when delivered with goods.

An alternative to the return transport is a so-called one way package which is disposed of after delivery.

Another common way to solve the problem is to provide the package with a so-called nesting function. This means that empty containers are partly placed in one another, by providing the containers with sloping sides.

Yet another way to solve the problem is to dismantle or fold the sides of the container. The mostly known side dismantling is the pallet and pallet collar. An example of commonly used containers with foldable sides is the collapsible pallet container. The sides are here made foldable by attaching their respective lower end to the bottom part via a hinge.

A disadvantage with this type of container is that the load carrying ability is radically impaired when compared to solid, non-collapsible containers. This is mainly due to the fact that the corner parts, on non-collapsible containers taking up around 80% of the weight from above, are parted on collapsible containers. Since these load carrying corners are parted on collapsible containers, this will have to be compensated for by adding reinforcing ribs on the sides. This will, besides added weight, also cause difficulties when cleaning the container due to the number of small pockets that are formed between the ribs.

According to the present invention is it possible to manufacture a collapsible container where the above mentioned disadvantages are avoided. The invention relates to a collapsible container for transport and storage, comprising a bottom part and inwards foldable side walls. The parts are manufactured by injection moulding of a thermoplastic material. The invention is characterised in that the side walls are movably connected to the bottom part by hinges. The hinges are formed by a number of lower hinge-parts which are manufactured in one piece together with the bottom part and a number of upper hinge-parts which are manufactured in one piece together with the foldable side walls. Two side walls, placed on opposite sides, preferably the two long-side walls are provided with an inwards angled edge at each of their two ends. The edges connect with the adjoining side walls, preferably the short-side walls, when in an upright position. The inwards angled edges are provided with a number of coupling devices which are intended to interact with corresponding couplings placed at the ends of the adjoining side walls so that the side walls can be locked together in an upright position. At least two opposite side walls, suitably the long-side walls, preferably all four side walls, are provided with a hollow channel-like reinforcing profiles which stretches along at least three sides of each of the side walls, wherein one of the sides always is a the upper side. The reinforcing hollow profiles will hereby constitute an effective replacement for the reinforcing rib profiles that normally are used, whereby a lighter and more hygienic design is achieved. The hollow profiles can suitably be achieved by substantially filling the mould with molten thermoplastic material from an injection nozzle. The molten thermoplastic material is then allowed to solidify somewhat on the surface closest to the inner walls of the mould cavity. A pressurised gas is thereafter injected through an intake suitably placed at one end of the profile. The gas is allowed to flow into the still molten plastic in the core of the profile wherein a cavity is formed in the profile. The still molten plastic is hereby ejected from of the mould cavity. A container of this type can suitably be made from a polymer material from the group, polyethylene, polypropylene, polyamide, polystyrene, acryle-butadiene-styrene, polyalkylene-terephthalate or the like.

Suitably at least two opposite side walls, preferably all four, are provided with handle openings close to their respective upper sides. The handle openings are placed so that the reinforcing profiles form the upper edge of the handle.

The short-side walls are preferably provided with guiding and load-transferring guiding organs which are intended to interact with corresponding receiving means placed on the inside of the two inwards angled edges of the long-side walls. The shearing stress between two adjoining walls will hereby be transferred more effectively so that stress on the coupling means is decreased.

The bottom part is preferably, as seen from above, provided with recessed support profiles along the edges. The support profiles are usually provided with draining holes. The lower surface of said support profiles forms the support surface of the container. The support profiles also limit side-ways shifting when containers are stacked upon one-another. The long-side walls are preferably provided with inwards recessed sections at their lower edges, as seen when in an upright position. The recesses are intended to receive the support profiles when containers are stacked with the side walls in a down-folded position.

The coupling devices are preferably manufactured in one piece together with the short-side walls. The coupling devices preferably include a locking lip placed on the outer end of one side of a rib, which rib on both sides are enclosed by holes. A spring rib runs from the farther end of one of the holes to the other side of outer side of the rib.

The invention is explained further together with enclosed drawings, all showing the same embodiment of the invention wherein, FIG. 1 shows, in perspective seen from above, a collapsible container with the side walls 1 in an upright position.

Figure 1:
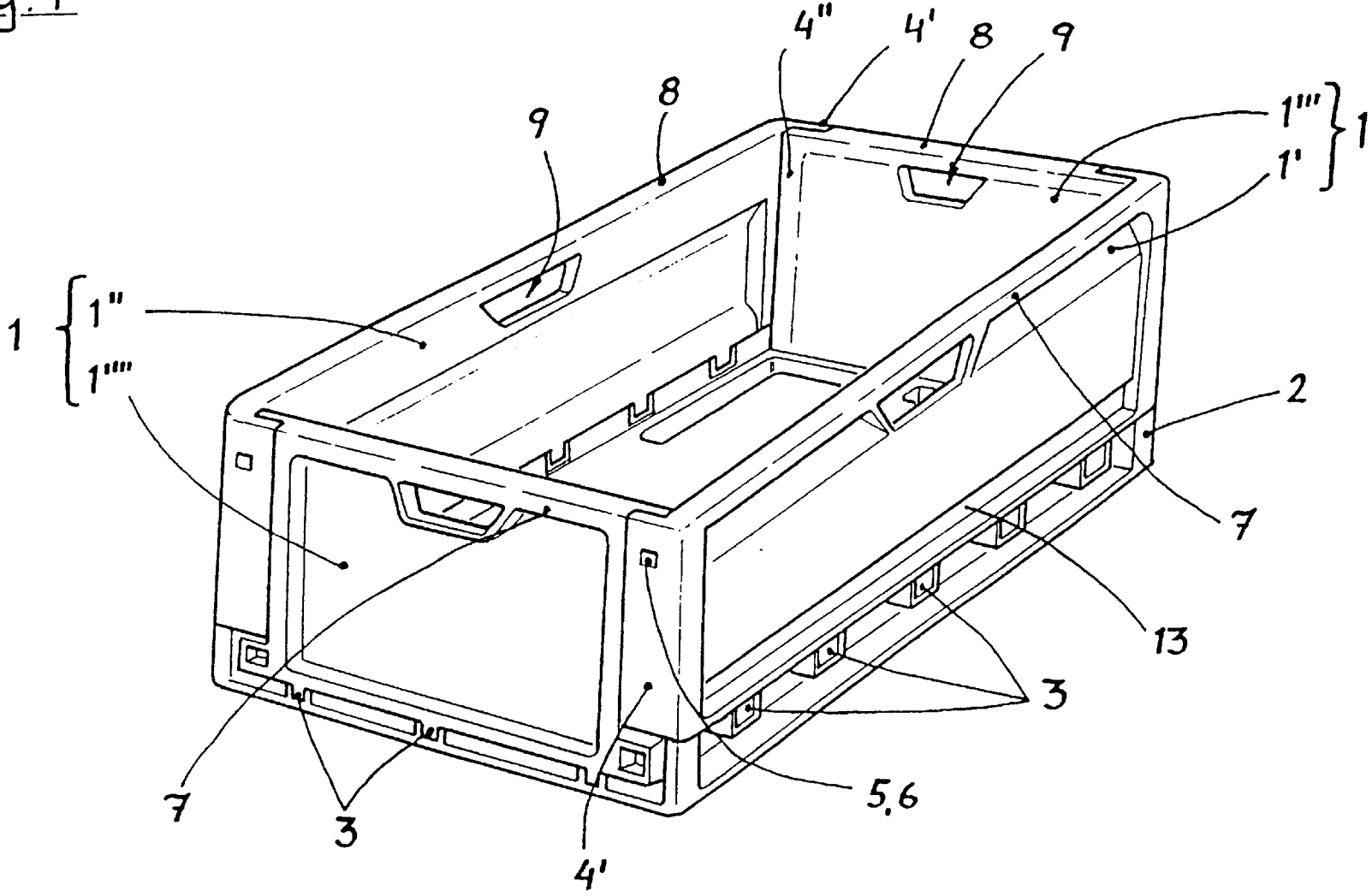

FIG. 1 shows one embodiment of a collapsible container according to the invention. The collapsible container comprises one bottom part 2 and collapsible side walls 1. The parts 1, 2 are manufactured by injection moulding of a thermoplastic material. The side walls 1 are movably connected to the bottom part 2 via hinges 3. The hinges 3 are formed by a number of lower hinge-parts 3' (FIG. 2) which are manufactured in one piece together with the bottom part 2, and a number of upper hinge-parts 3" (FIG. 2) which are manufactured in one piece together with their respective, foldable side walls 1. Both of the two long-side walls 1', 1" are provided with an inwards angled edge 4' at each of their two ends. The edges 4' connect with the adjoining short-side walls 1'", 1"". The inwards angled edges 4' are provided with a number of coupling devices 5 (FIG. 4) which are intended to interact with corresponding couplings 6 (FIG. 3) placed at the ends 4" of the adjoining short-sides 1'", 1"". All four of the side walls 1 are provided with a channel-like, hollow reinforcing profile 7 which runs along the two vertical sides and the upper horizontal side 8 of the side walls 1.

Figure 2:
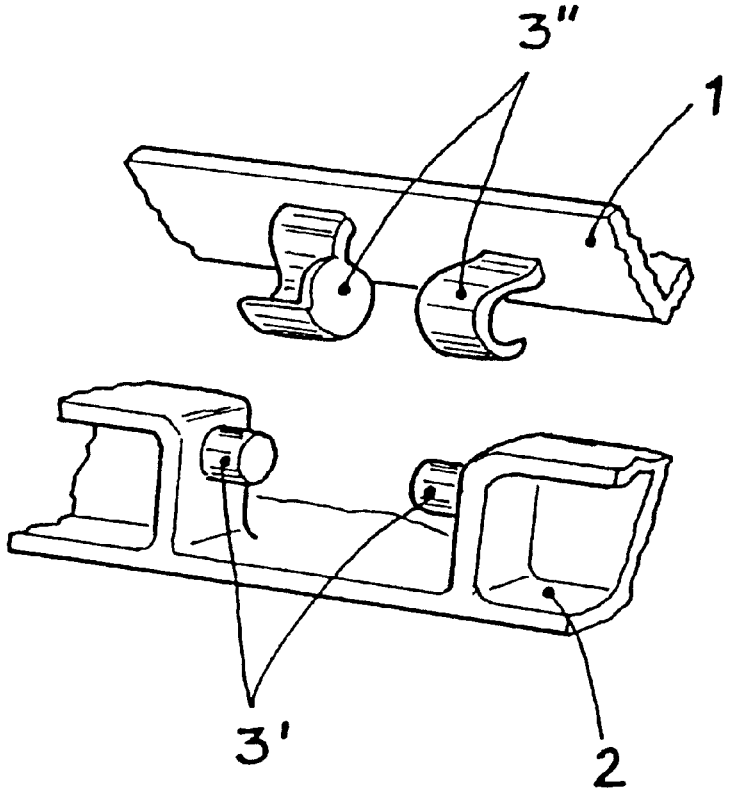
FIG. 2 shows, in perspective, a part of a hinge between a side wall 1 and a bottom part 2.

FIG. 2 shows in perspective a hinge between a side wall 1 with upper hinge-parts 3" and a bottom part 2 with lower hinge-parts 3'.

Figure 3:
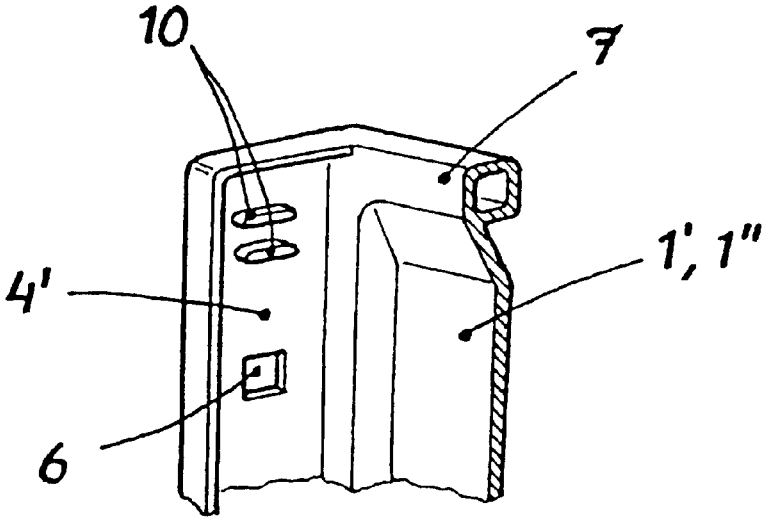
FIG. 3 shows, in perspective, a part of a long-side wall with receiving means.
Figure 4:
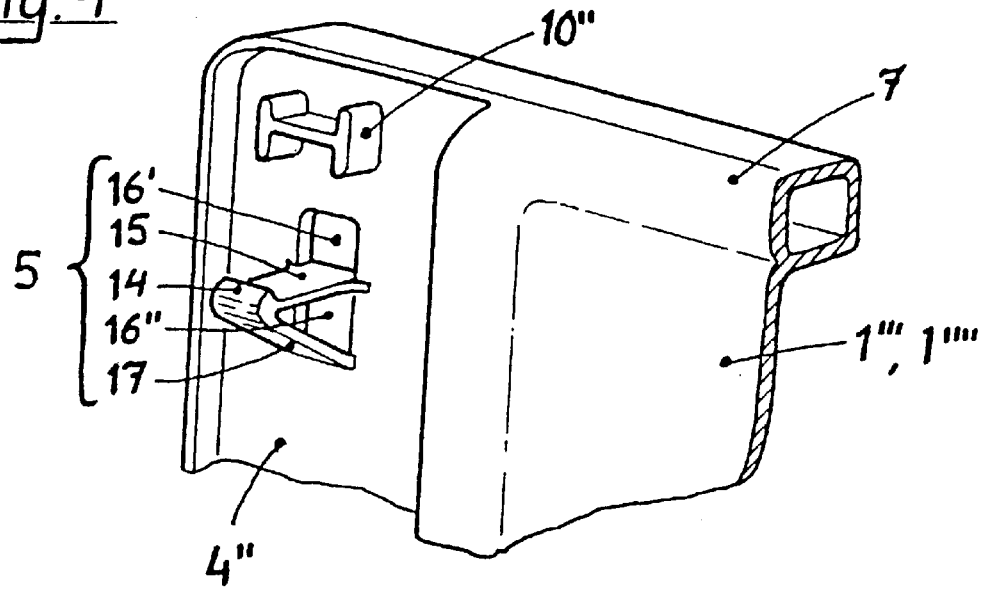
FIG. 4 shows, in perspective, a part of a short-side wall with guiding means.

FIG. 3 shows in perspective a part of a long-side wall 1', 1", while FIG. 4 shows in perspective, a part of a short-side wall 1'", 1"". The short-side walls 1'", 1"" (FIG. 4) are at both their ends 4" provided with guiding and load-transferring means 10" which are intended to interact with corresponding receiving means 10' (FIG. 3) placed on the inside of the inwards angled edges 4' of the two long-side walls 1', 1". The coupling devices 5, which are manufactured in one piece together with the short-side walls 1'", 1"" include a locking lip 14 placed on the outer end of a first side of a rib 15. The rib is on both sides enclosed by holes 16', 16". A spring rib 17 runs from the farther edge of one hole 16" to the second side of the outer end of the rib 15.

Figure 5:
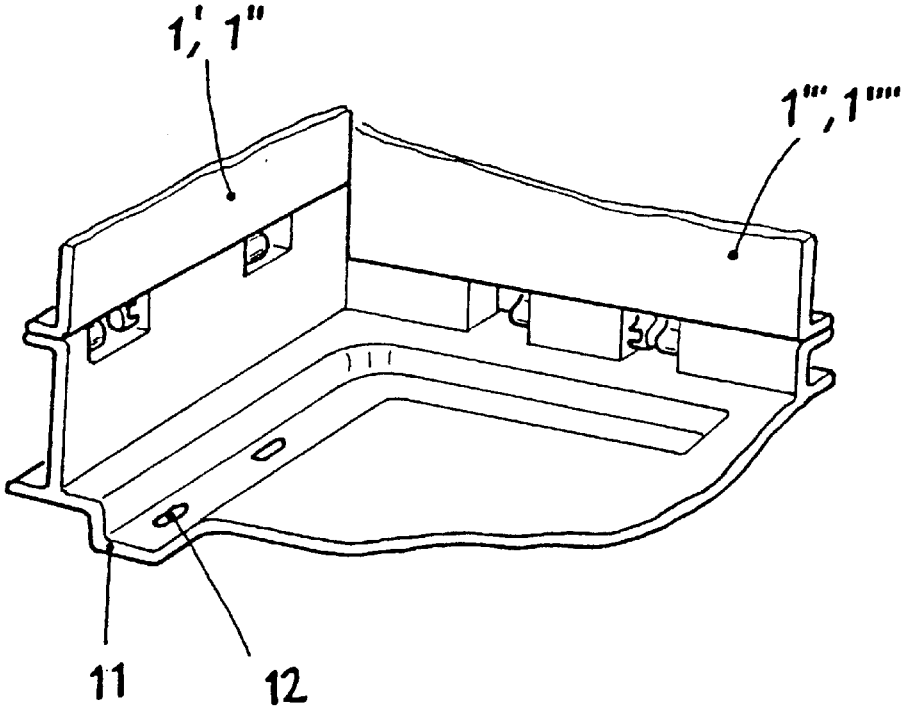
FIG. 5 shows, in perspective, a part of the bottom part 2 seen from the inside.

FIG. 5 shows in perspective a part of a bottom part 2 seen from the inside. The bottom part 2 is along its edges provided with recessed support profiles 11, provided with draining holes 12. The lower surface of the support profiles 11 forms the support surface of the container. The support profiles also limit side-ways shifting when containers are stacked upon one another. The long-side walls 1', 1" (FIG. 1) are provided with inwards recessed sections 13 at their lower edges, as seen when in an upright position. The recesses 13 are intended to receive the support profiles 11 (FIG. 5) when containers are stacked upon one another with the side walls 1 in a down-folded position.

The invention is not limited to the embodiment shown, since it can be varied in different ways within the scoop of the invention.

I claim:

1. Collapsible container for transport and storage, comprising a bottom part (2) and inwards foldable side walls (1), which parts (1, 2) are manufactured through injection moulding of a thermoplastic material, characterised in that the side walls (1) are movably connected to the bottom part (2) via hinges (3), formed by a number of lower hinge-parts (3') which are manufactured in one piece together with the bottom part (2) and a number of upper hinge-parts (3") which are manufactured in one piece together with the foldable side walls (1), that two side walls (1), placed on opposite sides, preferably the two long-side walls (1', 1"), are provided with an inwards angled edge (4') at each of their two ends, which edges (4') in an upright position connect with the adjoining side walls (1), preferably the short-side walls (1'", 1""), that the inwards angled edges (4') are provided with a number of coupling devices (5) which are intended to interact with corresponding couplings (6) placed at the ends (4") of the adjoining side walls (1) so that the side walls (1) can be locked together in an upright position, and that at least two opposite side walls (1), suitably the long-side walls (1', 1"), preferably all four side walls (1', 1", 1'", 1"") are provided with a hollow channel-like reinforcing profile (7) which runs along at least three sides of each of the side walls (1), wherein one of the sides is always an upper side (8).

2. Collapsible container according to claim 1 wherein at least two opposite side walls (1), preferably all four, are provided with handle openings (9) close to the respective upper sides (8) and that handle openings (9) are placed so that the reinforcing profile (7) forms the upper edge of the handle.

3. Collapsible container according to claim 1 wherein the short-side walls (1'", 1"") are provided with guiding and load-transferring guiding means (10") which are intended to interact with corresponding receiving means (10') placed on the inside of the two inwards angled edges (4') of the long-side walls (1', 1").

4. Collapsible container according to claim 1 wherein the bottom part (2) is provided with recessed support profiles (11), as seen from above, along the edges, which support profiles (11) are provided with draining holes (12), that the lower surface of said support profiles (11) forms the support surface of the container and that it limits side-ways shifting when containers are stacked upon one-another.

5. Collapsible container according any of the claim 1 wherein the long-side walls (1', 1") are provided with recessed sections (13) at their lower edges which are intended to receive the support profiles (11) when containers are stacked with the side walls (1) in a down-folded position.

6. Collapsible container according to claim 1 wherein the coupling devices (5), which are manufactured in one piece together with the short-side walls (1'", 1""), include a locking lip (14) placed on the outer end of one side of a rib (15), which rib (15) on both sides are enclosed by holes (16', 16"), and that a spring rib (17) runs from the farther end of one of the holes (16") to the other side of the outer side of the rib (15).

7. Collapsible container according to claim 2 wherein the short-side walls (1'", 1"") are provided with guiding and load-transferring guiding means (10") which are intended to interact with corresponding receiving means (10') placed on the inside of the two inwards angled edges (4') of the long-side walls (1', 1").

8. Collapsible container according to claim 2 wherein the bottom part (2) is provided with recessed support profiles (11), as seen from above, along the edges, which support profiles (11) are provided with draining holes (12), that the lower surface of said support profiles (11) forms the support surface of the container and that it limits side-ways shifting when containers are stacked upon one-another.

9. Collapsible container according to claim 3 wherein the bottom part (2) is provided with recessed support profiles (11), as seen from above, along the edges, which support profiles (11) are provided with draining holes (12), that the lower surface of said support profiles (11) forms the support surface of the container and that it limits side-ways shifting when containers are stacked upon one-another.

10. Collapsible container according to claim 2 wherein the long-side walls (1', 1") are provided with recessed sections (13) at their lower edges which are intended to receive the support profiles (11) when containers are stacked with the side walls (1) in a down-folded position.

11. Collapsible container according to claim 3 wherein the long-side walls (1', 1") are provided with recessed sections (13) at their lower edges which are intended to receive the support profiles (11) when containers are stacked with the side walls (1) in a down-folded position.

12. Collapsible container according to claim 4 wherein the long-side walls (1', 1") are provided with recessed sections (13) at their lower edges which are intended to receive the support profiles (11) when containers are stacked with the side walls (1) in a down-folded position.

13. Collapsible container according to claim 2 wherein the coupling devices (5), which are manufactured in one piece together with the short-side walls (1'", 1""), include a locking lip (14) placed on the outer end of one side of a rib (15), which rib (15) on both sides are enclosed by holes (16', 16"), and that a spring rib (17) runs from the farther end of one of the holes (16") to the other side of the outer side of the rib (15).

14. Collapsible container according to claim 3 wherein the coupling devices (5), which are manufactured in one piece together with the short-side walls (1''', 1''''), include a locking lip (14) placed on the outer end of one side of a rib (15), which rib (15) on both sides are enclosed by holes (16', 16''), and that a spring rib (17) runs from the farther end of one of the holes (16'') to the other side of the outer side of the rib (15).

15. Collapsible container according to claim 4 wherein the coupling devices (5), which are manufactured in one piece together with the short-side walls (1''', 1''''), include a locking lip (14) placed on the outer end of one side of a rib (15), which rib (15) on both sides are enclosed by holes (16', 16''), and that a spring rib (17) runs from the farther end of one of the holes (16'') to the other side of the outer side of the rib (15).

16. Collapsible container according to claim 5 wherein the coupling devices (5), which are manufactured in one piece together with the short-side walls (1''', 1''''), include a locking lip (14) placed on the outer end of one side of a rib (15), which rib (15) on both sides are enclosed by holes (16', 16''), and that a spring rib (17) runs from the farther end of one of the holes (16'') to the other side of the outer side of the rib (15).

* * * * *